United States Patent [19]

Mullins

[11] 4,078,760

[45] * Mar. 14, 1978

[54] COMBINATION DIE AND PALLET

[76] Inventor: Wayne L. Mullins, 5001 E. Cactus, Scottsdale, Ariz. 85254

[ * ] Notice: The portion of the term of this patent subsequent to Dec. 21, 1993, has been disclaimed.

[21] Appl. No.: 736,725

[22] Filed: Oct. 29, 1976

Related U.S. Application Data

[63] Continuation-in-part of Ser. No. 681,419, Apr. 29, 1976, Pat. No. 3,998,423.

[51] Int. Cl.[2] ..... B28B 7/24; B28B 7/26

[52] U.S. Cl. ..... 249/120; 249/119; 425/DIG. 118

[58] Field of Search ..... 249/119, 120, 129, 175, 249/189, 176, DIG. 118; 108/51.3, 53.1, 57.1

[56] References Cited

U.S. PATENT DOCUMENTS

| | | | |
|---|---|---|---|
| 2,763,911 | 9/1956 | Rumble | 249/189 X |
| 2,821,943 | 2/1958 | Friedwald | 249/120 |
| 2,892,238 | 6/1959 | Budd | 249/175 X |
| 3,010,174 | 11/1961 | McCall | 249/119 X |
| 3,113,532 | 12/1963 | White | 108/51.3 |
| 3,998,423 | 12/1976 | Mullins | 249/120 |

*Primary Examiner*—J. Howard Flint, Jr.
*Attorney, Agent, or Firm*—John A. Robertson; Herbert E. Haynes, Jr.

[57] ABSTRACT

A combination die and pallet of honeycombed construction comprising an upper rectangular die plate having frusto conical depressions stamped therein and side and end flanges integrally joined to and depending from the die plate together with a base plate of the same size and shape as the die plate. A plurality of inverted U shaped channel members are interposed between the die and base plates between longitudinal rows of the depressions and welded to the plates. The base plate has side and end flanges that are partially overlapped by the corresponding flanges on the die plate and welded thereto. The bottoms of the depressions are also welded to the base plates.

15 Claims, 8 Drawing Figures

COMBINATION DIE AND PALLET

This application is a continuation-in-part of the copending application of Wayne L. Mullins, Ser. No. 681,419, filed Apr. 29, 1976, entitled: COMBINATION DIE AND PALLET which issued on Dec. 21, 1976 as U.S. Pat. No. 3,998,423.

The present invention relates to dies which are used in forming projections on building blocks and is concerned primarily with such a die which is of a honeycombed construction to impart to the die the ability to function as a pallet for subsequent handling of building blocks after an upper die part is removed.

BACKGROUND OF THE INVENTION

At the present time, interlocking building blocks of rectangular shape have conical recesses in their lower faces and complemental conical projections on their upper faces. The recesses and projections are ordinarily arranged in similar patterns of two rows with four elements in each row which are all equidistantly spaced apart so that the four recesses and projections at each end define a square and the four central or intermediate recesses and projections define a square of the same size and shape as the end squares.

These building blocks are of a cementitious material and are ordinarily formed in molds which from the view point of efficiency of production casts a plurality of the blocks on a single operation. Such molds include as an essential element, a lower die plate which is formed with a plurality of frusto conical recesses which form projections on the blocks. The recesses in the blocks themselves are formed by apparatus and steps which are not a part of the present invention.

After a block has been cast, an upper mold part is removed and the blocks are subject to subsequent handling. It is the practice to remove the blocks from the upper die plate and cure them on a pallet so that they can be handled in multiple lots. The lower die plates which are now known and available are not shaped and sufficiently strong and rigid to permit them for use as a pallet for this subsequent handling of the blocks.

In the above identified application the base plate is formed with a plurality of longitudinal ribs which upstand from its upper face and the formation of which leave grooves on the lower face. While this construction has proven to be satisfactory under many conditions, it is not sufficiently strong and rigid to, under some conditions, support the load thereupon particularly when it is used as a pallet. Also, the grooved underface of the base plate impairs its use to support stringer blocks having flat faces which are free of projections.

OBJECTS OF THE INVENTION

With the foregoing conditions in mind the present invention has in view the following objectives:

1. To provide a combination die and pallet which is of a honeycombed construction which provides sufficient strength and rigidity to accommodate handling of a plurality of blocks after casting and setting.

2. To provide a combination die and pallet, of the type noted, which includes as a characteristic and essential element an upper die plate having a plurality of frusto conical depressions stamped therein and arranged to provide the projections on a plurality of building blocks which are molded on the die plate.

3. To provide, in a combination die and pallet of the character aforesaid, which is rectangular and the depressions are arranged in longitudinal and transverse rows to accommmodate a plurality of blocks which are molded on the plate.

4. To provide, in a combination die and pallet of the kind described, a die plate having side and end flanges integral with the die plate.

5. To provide, in a combination die and pallet of the type noted, a base plate of the same size and shape as the die plate together with a plurality of inverted U shaped channel members, which, when the two plates are assembled assume positions between longitudinal rows of the depressions in the die plate. These channel members are welded to either of the plates or both of them.

6. To provide, in a combination die and pallet of the character aforesaid, a base plate having side and end flanges that are partially overlapped by the corresponding flanges on the die plate and welded thereto. The base plate is also spot welded to the bottoms of the depressions on the die plate.

7. To provide, in a combination die and pallet of the kind described, die and base plates having overlapping side flanges which are formed with slots which align to provide drain openings.

8. To provide, in a combination die and pallet of the type noted, inverted U shaped channel members which are positioned longitudinally between longitudinal rows of depressions on one die plate.

9. To provide, in a combination die and pallet of the character aforesaid, inverted U shaped channel members which are disposed on the bias between longitudinal rows of depressions in the die plate.

Various other more detailed objects and advantages of the invention, such as arise in connection with carrying out the above ideas in a practical embodiment will, in part, become apparent and, in part, be hereinafter stated as the description of the invention proceeds.

SUMMARY OF THE INVENTION

The foregoing objects are achieved by providing a combination die and pallet which comprises a die plate of rectangular shape and dimensioned to accommodate the casting of a plurality of building blocks thereon. The die plate is formed with a plurality of frusto conical depressions each having a conical wall and a bottom wall. These depressions are arranged in longitudinal and transverse rows and are spaced apart in accordance with the pattern of the projections which are to be formed on each block. Depending from the side and end edges of the die plate are side and end flanges which are integral with the die plate and which have a height slightly less than the depth of the depressions.

The side flanges are formed with a slot adjacent to one end and a pair of spaced slots adjacent to the other end.

A base plate of the same size and shape as said die plate has side and end flanges upstanding therefrom which are partially overlapped by the corresponding flanges on the die plate and welded thereto. Each of the side flanges is formed with a slot at one end which aligns with a slot in a side flange of the die plate and a pair of slots at the other end which align with the pair of slots in a side flange of the die plate. These aligned slots provide drains which are needed when the die and pallet is removed from a cleaning solution. A plurality of inverted U shaped channel members have upper backs and side walls depending from the backs. The side walls of each channel member have outturned lips which engage the base plate and are welded thereto. The backs of the channel members may also be welded to the die plate. Thus, the channel members may be welded to either or both of the plates. The base plate is also spot welded to the bottoms of the depressions in the die plate.

In one embodiment the channel members are arranged longitudinally between longitudinal rows of depressions. In another embodiment the channel members are arranged on the bias between longitudinal rows of depressions in the die plate. Thus, they are slanted horizontally.

For a full and more complete understanding of the invention, reference may be had to the following description and accompanying drawings wherein.

DESCRIPTION OF THE PREFERRED EMBODIMENT

Figure 1:
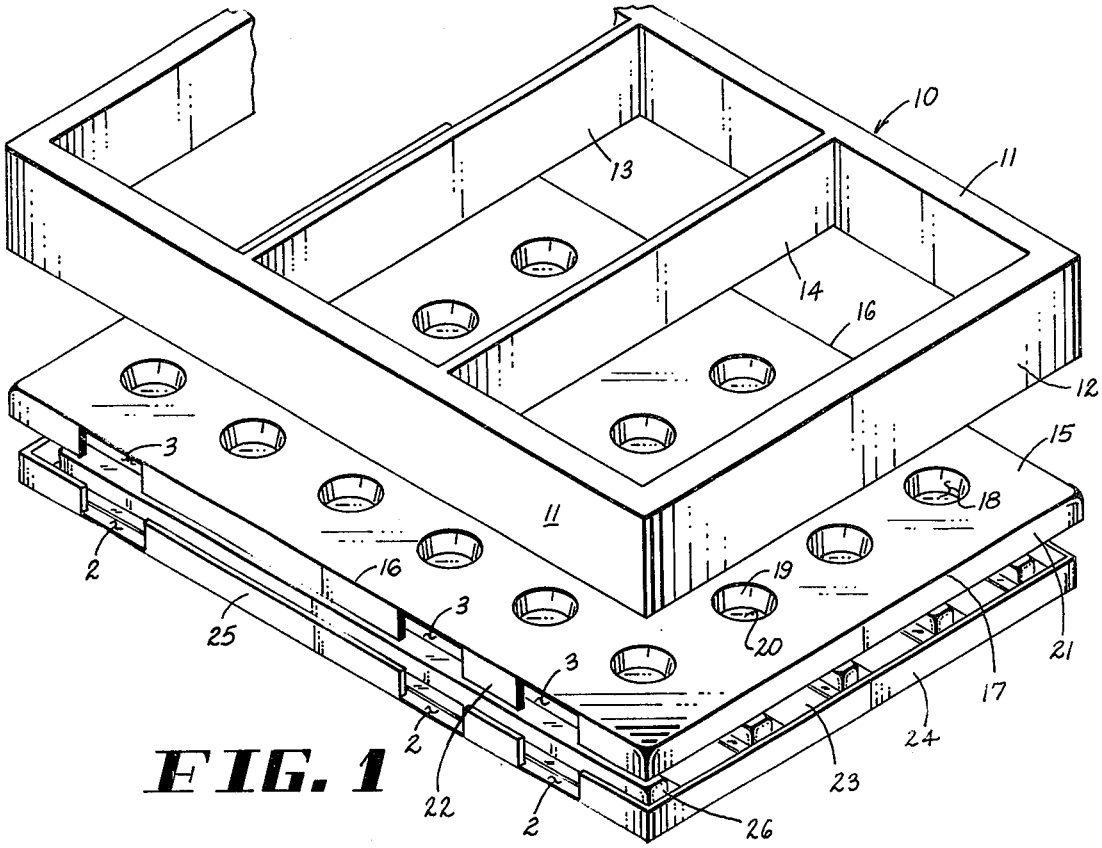
FIG. 1 is a perspective illustrating an upper mold part, a die plate which is associated therewith, a plurality of channel members, and a base plate in exploded relation.

Before entering into a detailed description of the two die and pallet assemblies illustrated in the drawings, it is noted that in the preferred embodiment of the invention the die and pallet are designed to accommodate three building blocks each of which is formed with eight projections on what is the lower face during the molding operation but what becomes the upper face in an actual building construction. These eight projections are arranged in two rows of four each with the four projections at one end defining a square, the four projections at the other end another square and the four intermediate or central projections a square of the same size and shape as the aforsaid end squares.

Figure 2:
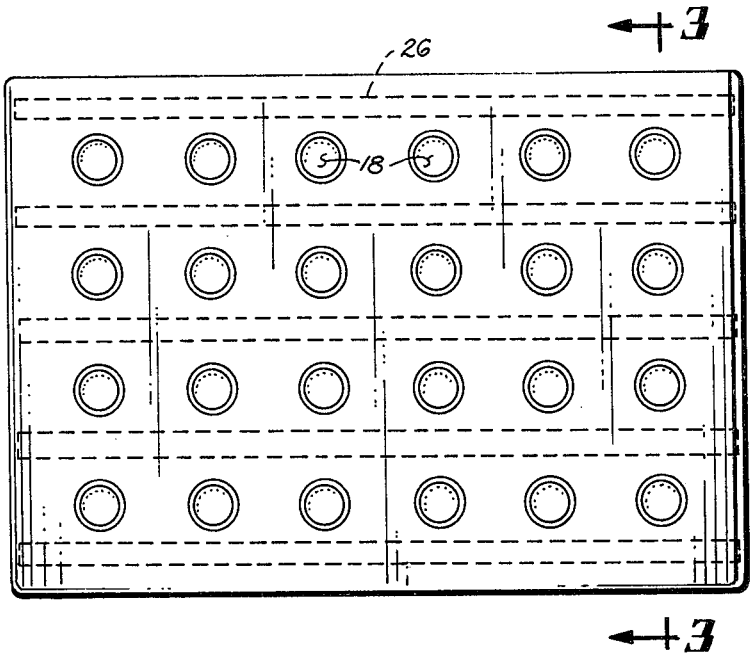
FIG. 2 is a top plan view of the die plate with the channel members shown therebeneath in one embodiment.
Figure 3:
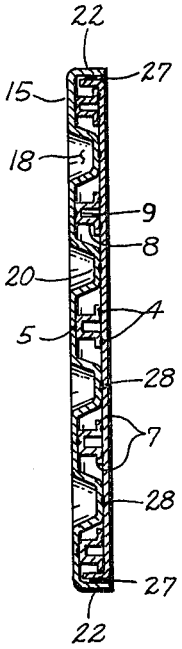
FIG. 3 is a transverse cross section of the combination die and pallet illustrating the base plate as assembled on the die plate, taken on the plane of line 3—3 of FIG. 2.

In accordance with the disclosures of FIGS. 1, 2, and 3, the pallet and die is designed to accommodate three of the above described building blocks. An upper mold part is designated 10 and it in itself is not a part of the present invention although it is related thereto. Thus, mold part 10 comprises side walls 11, end walls 12, and partitions 13 and 14 which extend between side walls 11. The present invention is concerned solely with the forming of projections on the lower face of the building block and is not concerned particularly with how recesses for receiving complemental projections of other blocks are formed on the upper face.

A die plate is designated 15. It is rectangular in shape and is defined by side edges 16 and end edges 17. As blocks are being molded the mold part 10 will rest on die plate 15 with the lower faces of walls 11 and 12 resting on the upper face of die plate 15 immediately adjacent to edges 16 and 17.

Die plate 15 is formed with 24 frusto conical depressions which are stamped thereinto by a well known metal stamping operation and each of which is referred to in its entirety as 18.

While the building blocks with which die plate 15 is used may have projections of various shapes the form most commonly used is frusto conical. Hence, a frusto conical shape of the depressions is illustrated on the drawing and herein described.

Each depression 18 is defined by a frusto conical wall 19 which hereinafter will be referred to as a conical wall and a bottom wall 20.

Die plate 15 is ordinarily of metal and end flanges 21 and side flanges 22 are formed integrally therewith. These flanges 21 and 22 have a height slightly less than the depth of depressions 18.

Each of the side flanges 22 is formed with a wide slot 3 adjacent to one end and another pair of similar slots 3 adjacent to the other end.

The base plate 23 is of substantially the same size and shape as die plate 15. It has end flanges 24 and side flanges 25. These flanges 24 and 25 are partially overlapped by the corresponding flanges 21 and 22 of die plate 15 with the flanges being welded together at the overlap as indicated at 27. Each of the side flanges 25 is formed with a slot 2 adjacent to one end and a pair of similar slots 2 adjacent to the other end. When the die and base plates are assembled slots 2 and 3 align to provide drains which are needed in many instances when the die and pallet is removed from a cleaning solution.

Each of a plurality of inverted U shaped channel members is identified in its entirety at 26. Each member 26 comprises an upper back 9 and side walls 8 depending from back 9 and having outturned lips 7 at their end edges. Channel member 26 may be welded to either or both of die plate 15 and base plate 23. Thus, back 9 is shown as welded to die plate 15 at 5 and lips 7 at base plate 23 at 4.

Channel members 23 are disposed longitudinally between plate 15 and 23 in FIGS. 1, 2, and 3. Thus, the two outermost members 26 are interposed between the two longitudinal rows of depressions 18 and the adjacent side edges of the plates. The remainder of the members 26, in this instance three rows, are positioned equidistantly between adjacent longitudinal rows of depressions 18.

Bottom walls 20 of depressions 18 are spot welded to base plate 23 as indicated at 28.

It is evident that with the mold part 10 resting on the die plate 15 in the manner above described cementitious material may be poured into the three chambers defined by partitions 13 and 14 and this material will enter the depressions 18. After the material is set mold part 10 is removed leaving three blocks resting on die plate 15. The latter due to its assembly with base plate 23 is now constituted a pallet which supports the three blocks for subsequent handling and manipulation therof. This strength and rigidity in the pallet is imparted by the honeycomb construction afforded by depressions 18 and channel members 26.

The drains provided by aligned slots 2 and 3 are often needed when the die and pallet is removed from a cleaning solution in which it was immersed.

FIRST MODIFICATION

Figure 4:
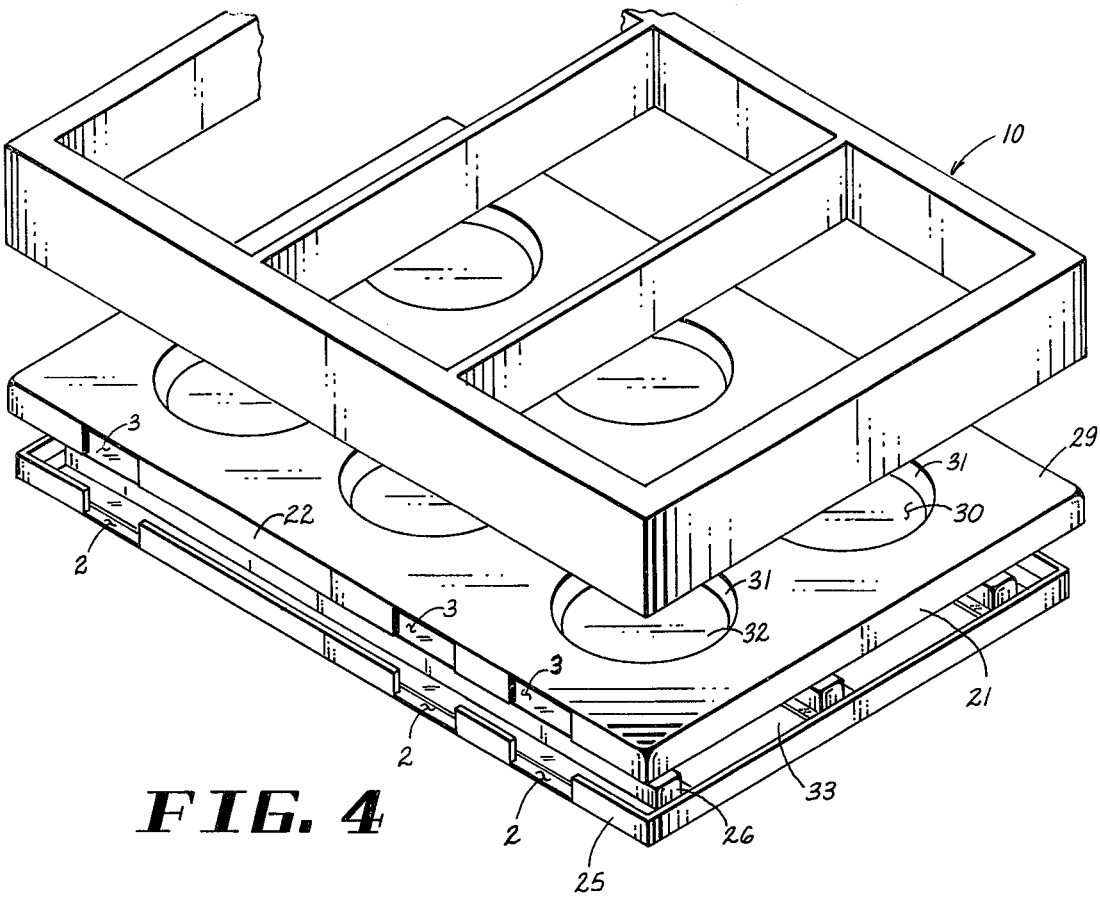
FIG. 4 is a perspective of a modification illustrating the elements thereof in exploded relation.
Figure 5:
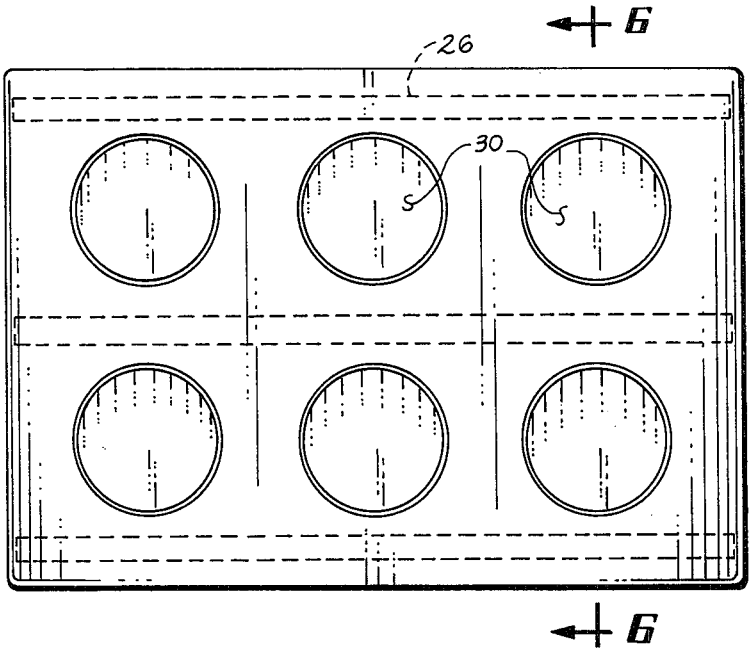
FIG. 5 is a top plan view of the die plate of FIG. 4 with the channel members therebeneath.
Figure 6:
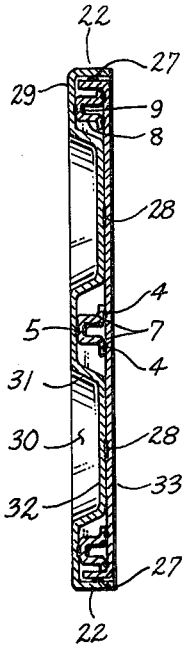
FIG. 6 is a transverse vertical section through the die plate and base plate of FIG. 4 as assembled, being taken on the plane of line 6—6 of FIG. 5.

Referring now more particularly to FIGS. 4, 5, and 6, a modified embodiemnt of the invention will be described. Certain interlocking building blocks are formed with only two conical depressions on one face and two complemental projections on the other face. FIGS. 4, 5, and 6, illustrate a combined die and pallet which is designed to accommodate three such blocks.

FIG. 4 illustrates a mold part 10 which is identical with the mold part 10 described in FIG. 1 and has the same function. A die plate 29 is of the same size and shape as of die plate 15 of FIGS. 1, 2, and 3, and has the same end and side flanges 21 and 22 with side flanges 22 having slots 3 in the same arrangement which obtains in FIG. 1. However, it is formed with six depressions each of which is identified in its entirety by the referene character 30. Each of these depressions 30 is defined by a conical wall 31 and a bottom wall 32. These six depressions are arranged in two rows of three each with each row being spaced from and parallel to a side flange 22. A base plate 33 is of the same size and shape as die plate 29. It has the same end and side flanges 24 and 25 as the embodiment of FIGS 1, 2, and 3 with side flanges 25 having slots 2 corresponding to slots 2 of FIG. 1. Slots 2 and 3 align to provide drains.

Three channel members 26 are welded to die plate 15 and base plate 33. These channel members are substantially identical with the channel members above described in conjunction with FIGS. 1, 2, and 3. One member 26 is disposed equidistantly between the two rows, three each, of depressions 30. Each of the other members 26 is interposed between side and edges of plates 29 and 33 and the two rows of depressions 30.

It is evident that with the mold part 10 and combined die and pallet of FIGS. 4, 5, and 6, the projections formed on the block will be solid and have continuous bottom surfaces. However, the same die and pallet assembly may be used to form blocks with projections in the form of rings or annular walls. This construction is achieved by employing proper mold elements which would be included as a part of the mold 10.

It is evident that channel members 26 together with the depressions 18 or 30 and the side and end flanges provide a honey-comb construction of high strength and rigidity which is of great importance when the device is used as a pallet. The presence of channel members 26 rather than the ribs in the device of the above identified application, affords a continuous smooth undersurface which adapts it for use in the handling of string blocks having smooth surfaces.

SECOND MODIFICATION

Figure 7:
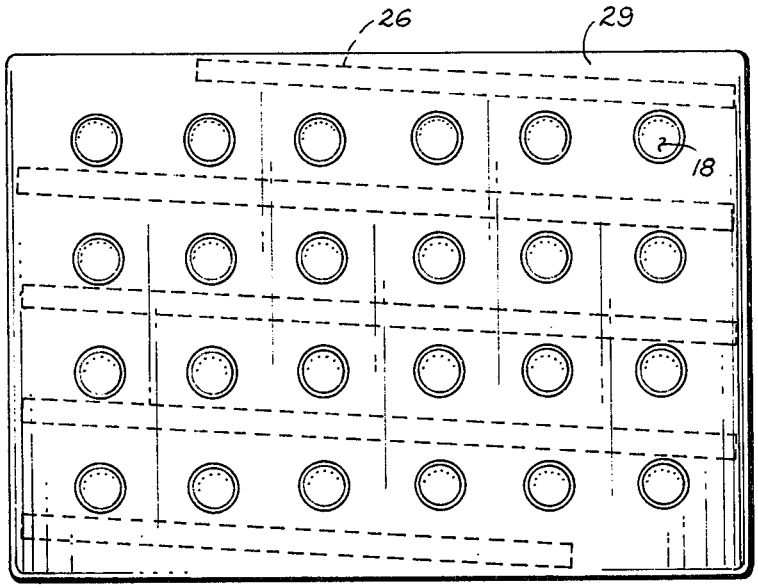
FIG. 7 is a top plan view of a portion of a modified embodiment in which the channel members are arranged on the bias between longitudinal rows of depressions in the die plate.

FIG. 7 illustrates another modification which is substantially the same as the embodiment of FIGS. 1, 2, and 3 with the notable exception that channel members 26 are arranged on the bias between longitudinal rows of depressions 18.

THIRD MODIFICATION

Figure 8:
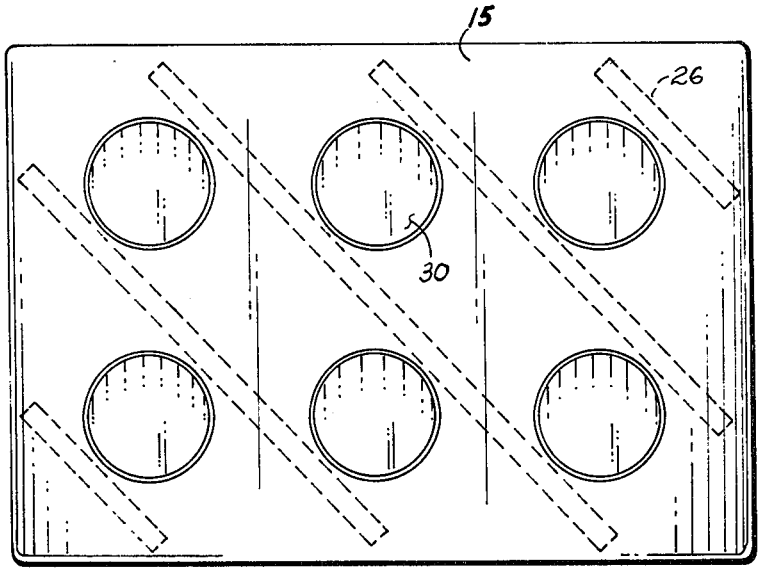
FIG. 8 is a top plan of another modification in which the channel members are disposed on the bias between rows of depressions.

FIG. 8 depicts a third modification in which channel members 26 are arranged on the bias between the die and base plates of the embodiment of FIGS. 4, 5, and 6. Thus, FIG. 8 shows channel members 26 at angles of 45° with respect to the side and end flanges of the plates.

While preferred specific embodiment of the invention are herein disclosed, it is to be clearly understood that the invention is not limited to the exact constructions, designs, and materials illustrated and described because various modifications of these details may be provided in putting the invention into practice.

I claim:

1. In a combination of die and pallet of honeycomb construction;

(a) a die plate of rectangular shape presenting end and side edges and formed with a plurality of depressions arranged in longitudinal rows, (b) each of said depressions having an inclined side wall and a flat bottom, (c) end flanges depending from said end edges and side flanges depending from said side edges, said flanges being integral with said die plate, having lower edges, (d) a rectangular base plate of the same size and shape as said die plate and presenting end and side flanges which are overlapped by the corresponding flanges on the die plate, (e) fused joints between said overlapping flanges, (f) spot fusions between said base plate and the bottoms of said depressions, and (g) a plurality of inverted U shaped channel members arranged between said die and base plates and alternately disposed between said side flanges and said longitudinal rows of depressions, said channel members being welded to one of said plates.

2. The combination die and pallet assembly of claim 1 which is dimensioned to accommodate three building blocks of the same thickness and each having a length twice as long as its width.

3. The combination die and pallet of claim 2 in which there are twenty-four of said depressions with there being four longitudinal rows of six of said depressions.

4. The combination die and pallet of claim 2 in which there are six of said depressions with there being three longitudinal rows of two of said depressions.

5. The combination die and pallet assembly of claim 1 in which the die and base plates are of metal and the fused joints between the flanges of the die and base plates are welds and the spot fusions are welds.

6. The combination die and pallet of claim 1 in which the channel members are welded to the other of said plates.

7. The combination die and pallet of claim 1 in which each channel member comprises an upper back engaging the undersurface of said die plate and side walls depending from said back and having outturned lips engaging the upper face of said base plate.

8. The combination die and pallet of claim 7 in which the back of the channel member is welded to the die plate.

9. The combination die and pallet of claim 7 in which the lips are welded to the base plate.

10. The combination die and pallet of claim 7 in which the backs of the channel members are welded to the die plate and the lips to the base plate.

11. The combination die and pallet of claim 1 in which the channel members are arranged longitudinally and parallel to the side edges of the plates.

12. The combination die and pallet of claim 1 in which the channel members are arranged on the bias with respect to the side and end flanges of said plates.

13. The combination die and pallet of claim 1 in which each side flange of each of said plates if formed with a slot which aligns with a slot in the side flange of the other plate with said aligned slots providing a drain.

14. The combination die and pallet of claim 13 in which said slots are located adjacent to ends of the flanges in which they are formed together with another set of aligned slots adjacent to the other end of said flanges.

15. The combination die and pallet of claim 14 in which there is a pair of sets of aligned slots at one end of said flanges.

* * * * *